United States Patent [19]

Mesker

[11] Patent Number: 4,574,698

[45] Date of Patent: Mar. 11, 1986

[54] APPARATUS FOR SERVICING PRINTING PRESS

[76] Inventor: Frederick R. Mesker, 2391 Leroy St., Kingman, Ariz. 86401

[21] Appl. No.: 630,669

[22] Filed: Jul. 13, 1984

[51] Int. Cl.[4] ..... B41L 41/00

[52] U.S. Cl. ..... 101/425; 101/423

[58] Field of Search ..... 101/423, 424, 425; 254/DIG. 7; 15/236 R, 257 R; 134/201

[56] References Cited

U.S. PATENT DOCUMENTS

| | | | |
|---|---|---|---|
| 1,201,971 | 10/1916 | Kaiser | 15/236 R |
| 1,238,641 | 8/1917 | Coon | 134/201 |
| 1,675,695 | 7/1928 | Claybourn | 101/364 |
| 2,302,490 | 11/1942 | Curtis | 101/425 |
| 2,780,822 | 2/1957 | Dickinson | 15/257 R |
| 2,900,656 | 8/1959 | Tupper | 15/236 R X |

FOREIGN PATENT DOCUMENTS

| | | | |
|---|---|---|---|
| 926173 | 9/1947 | France | 101/335 |
| 303124 | 11/1954 | Switzerland | 134/201 |
| 895125 | 5/1962 | United Kingdom | 101/425 |

*Primary Examiner*—Edgar S. Burr
*Assistant Examiner*—John A. Weresh
*Attorney, Agent, or Firm*—Drummond & Nissle

[57] ABSTRACT

Improved apparatus for servicing the inking assembly of a printing press. The apparatus minimizes the likelihood that supplies of different colored inks will be contaminated during the servicing of the inking assembly of a printing press and permits a pressman to completely service the inking assembly without having to leave the site of the printing press.

3 Claims, 4 Drawing Figures

FIG. 3
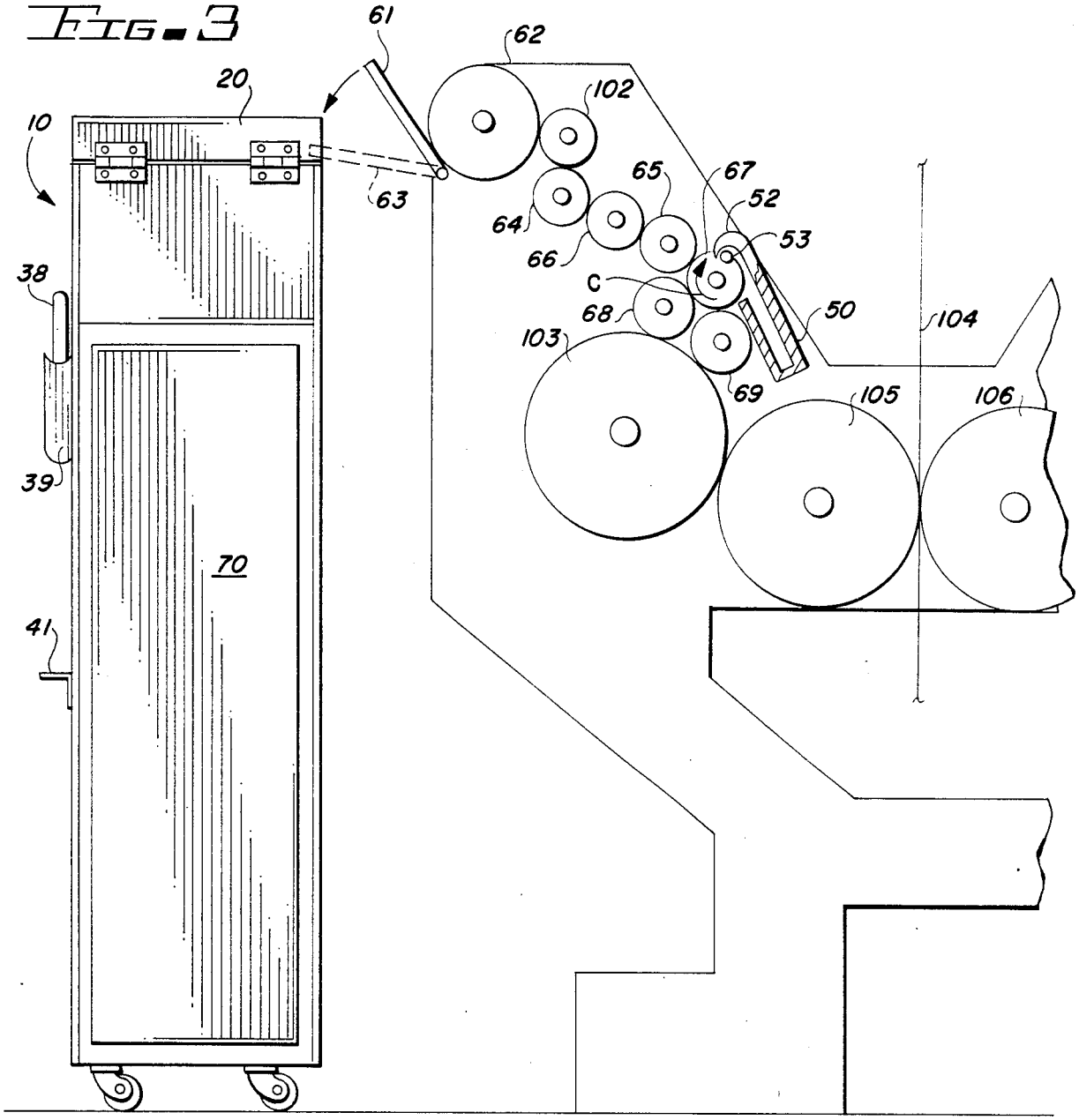
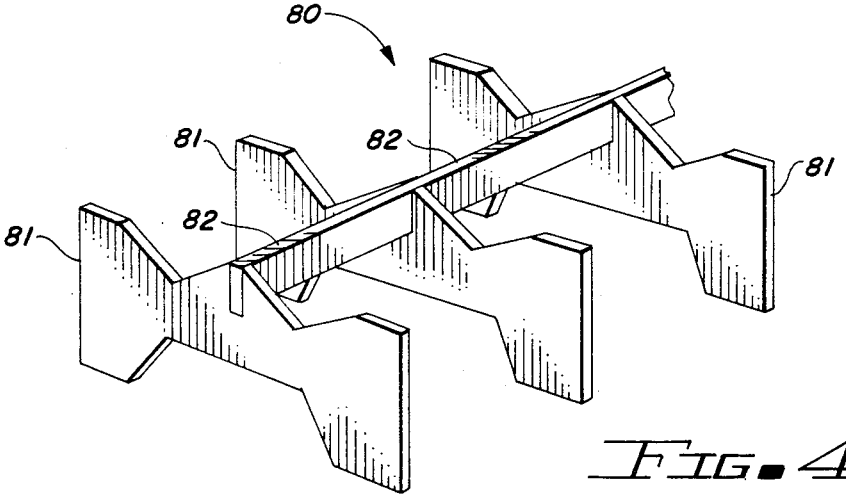
FIG. 4

APPARATUS FOR SERVICING PRINTING PRESS

This invention relates to apparatus for servicing a printing press.

More particularly, the invention relates to apparatus for maintenancing the ink fountain, indoctrination roller and other components of the inking assembly of a printing press.

In another respect, the invention relates to printing press inking assembly maintenance apparatus which, after a press has been utilized to print with an ink of one color, facilitates cleaning of the inking assembly when the press is being prepared to print utilizing fresh ink of another color.

In a further respect, the invention relates to printing press inking assembly maintenance apparatus which minimizes the likelihood of contamination of ink being removed from or placed into the ink fountain of a printing press.

In still another respect, the invention relates to printing press inking assembly maintenance apparatus which permits the tools used to service the inking assembly to be cleaned on site such that the tools which are used to clean ink of one color from the printing press inking assembly may also be safely utilized to prime the press with fresh ink of another color.

In yet a further respect, the invention pertains to printing press maintenancing apparatus which is portable and contains all requisite tools and supplies for servicing the inking assembly of a printing press.

In yet still another respect, the invention pertains to apparatus for maintenancing a printing press of the type including indoctrination rollers, transfer rollers, oscillating rollers and form rollers; the maintenancing apparatus including ink accumulation trays shaped and dimensioned to be positioned adjacent an oscillating roller such that ink on the surface of the roller is scraped from the roller into the tray when the roller is turning during operation of the printing press.

In another important respect, the invention pertains to printing press inking assembly maintenance apparatus which includes water-tight compartments adapted to store and clean ink accumulation trays and other tools used in preparing the inking assembly for color printing.

Servicing the inking assembly of large commercial printing presses utilized by newspaper and magazine publishers is a time consuming, exacting process. The inking assemblies of such printing presses typically include an ink fountain roller, an indoctrination roller, transfer rollers, oscillating rollers and form rollers. These inking assembly rollers form an interconnected "chain" in which the surface of each of the rollers contacts and rolls over the surface of at least one of the other rollers during operation of the printing press. A panel shaped member called an ink fountain is positioned adjacent and together with the ink fountain roller defines a storage compartment which is filled with fresh ink before the printing press is utilized. During the operation of the press, ink from the fountain is distributed over and adheres to the cylindrical surface of the ink fountain roller. Ink on the surface of the ink fountain roller is transferred from one roller surface to another through the inking assembly roller chain until the ink reaches the surface of the form rollers. The form rollers contact and transfer ink to a plate or a cylindrical printing plate.

When the inking assembly of a printing press is being cleaned, residual ink must be carefully removed from the ink fountain and each roller in the roller chain. It is particularly critical that the inking assembly of a printing press be thoroughly cleaned when the press is, after being used to print in black ink, being adapted for color printing. Even small traces of black ink remaining in the inking assembly will travel through the roller chain along with fresh color ink being utilized in the press and will flaw the printing on paper sheets traveling through the press.

The conventional procedure for servicing the ink of a printing press is a time consuming process. During this process, a pressman obtains a partially emptied container of black ink and an "ink" knife. An ink knife is similar in contour to a putty knife, and includes a wide flat blade. The pressman uses the ink knife to scrape residual ink from the fountain into the ink container. After the majority of residual ink is scraped from the fountain, the fountain is thoroughly washed with clean rags and a solution of ink solvent.

Since on many printing presses the ink fountain is six or seven feet above the floor, the pressman must obtain and utilize a ladder when cleaning the fountain. Black ink scraped from the fountain into the ink container can be reused if the ink is not contaminated by dirt, by ink solvent fluid used to clean the fountain, or by colored ink subsequently utilized to prime the printing press. Since the pressman cleaning the fountain often does not wish to take the time to step down from the ladder and place the container of residual black ink from the fountain in a sheltered position away from the printing press, ink solvent, dirt and colored ink sometimes fall into and contaminate the container of black ink.

Before a tool utilized to clean black ink from the inking assembly of a printing press can be used to prime the press with colored ink, the tool must be carefully cleaned with "blanket" wash or some other ink solvent. Sinks and other cleaning facilities normally are not located adjacent a printing press. This means the pressman must either leave the pressroom and walk to another area to clean his tools before using them with colored ink, or, must be equipped with two sets of tools, one set for working with black ink and another set for handling red ink, green ink or other colored inks.

Accordingly, it would be highly desirable to provide apparatus which would permit the ready maintenance of the inking assembly of a printing press while minimizing the likelihood that containers of ink will be contaminated during servicing of the inking assembly.

It would also be highly desirable to provide inking assembly maintenance apparatus which would permit a pressman to utilize a single set of inking tools when cleaning black ink from an inking assembly of a printing press and priming the assembly with fresh colored ink and, which would provide all necessary supplies and tools for servicing the inking assembly of a printing press such that the pressman would not, after beginning to service the press, have to leave the site of the press to perform other functions necessary for completion of the servicing of the printing press.

Therefore, it is a principle object of the invention to provide improved apparatus for servicing the inking assembly of a printing press.

Another object of the invention is to provide improved inking assembly maintenancing apparatus which minimizes the likelihood that supplies of black or colored ink will be contaminated during the servicing of the inking assembly of a printing press.

A further object of the invention is to provide improved printing press inking assembly maintenance apparatus which only requires the use of a single set of inking tools to clean ink of one color from a printing press and prepare the press to print using ink of another color.

Still another object of the invention is to provide improved printing press inking assembly maintenance apparatus which permits a pressman to completely service the inking assembly of a printing press without leaving the site of the press.

Yet another object of the instant invention is to provide improved printing press inking assembly maintenance apparatus which can readily be utilized to service the inking assemblies of printing presses having ink fountains or other ink dispensing units positioned at varying heights from the ground.

These and other, further and more specific objects and advantages of the invention will be apparent to those skilled in the art from the following detailed description thereof, taken in conjunction with the invention drawings, in which:

FIG. 3 is a side elevation view of the printing press inking assembly maintenance apparatus of FIGS. 1 and 2 positioned adjacent a printing press; and, FIG. 4 is a perspective view illustrating the support grating utilized in the fluid-tight fold-down container door of the apparatus of FIGS. 1 and 2.

Figure 1:
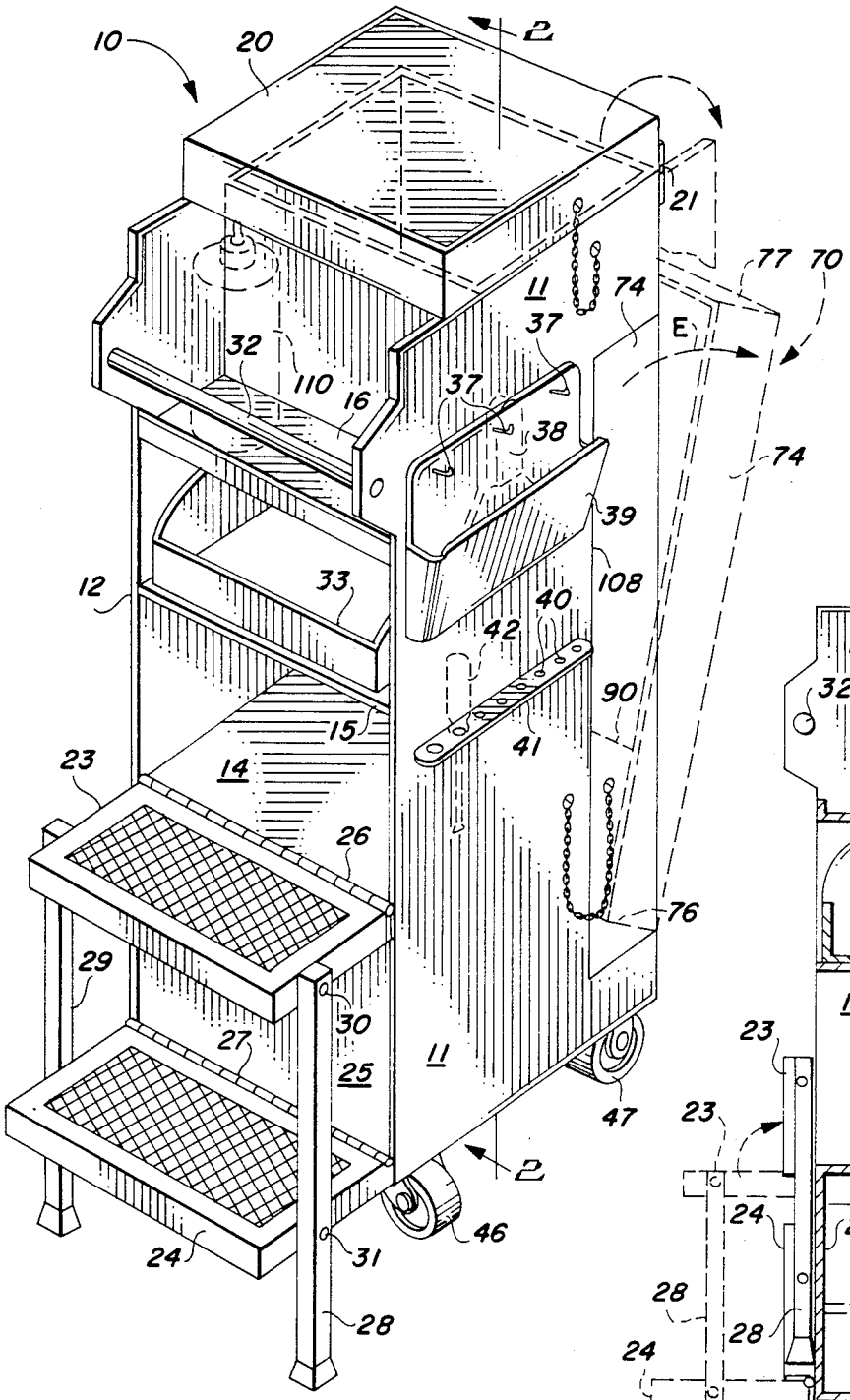
FIG. 1 is a perspective view of printing press inking assembly maintenance apparatus constructed in accordance with the principles of the invention.

Briefly, in accordance with my invention, I provide an improved apparatus for servicing the inking assembly of a printing press. The inking assembly includes operatively associated rollers for transferring and dispensing ink to be applied to sheet material passing through the printing press and includes an ink fountain for storing and dispensing to the rollers a supply of printing ink. The inking assembly maintenancing apparatus includes a frame; at least one ink accumulation tray shaped and dimensioned to be positioned adjacent and scrape ink from one of the printing press ink assembly rollers; means for removably carrying and storing the ink accumulation tray on the frame; an ink knife having a handle and blade; means for carrying and storing the ink knife on the frame, the ink knife storage means including a reservoir of cleaning fluid contacting at least a portion of the blade when the ink knife is carried on the frame by the ink knife storage means; a container of ink solvent fluid; a fluid-tight cleaning sink carried on the frame; a container carried on the frame for receiving and storing black ink; and, a container carried on the frame for receiving and storing a colored ink.

Turning now to the drawings, which depict the presently preferred embodiments and best mode of the invention for the purpose of illustrating the practice thereof and not by way of limitation of the scope of the invention and in which like reference characters represent corresponding elements throughout the several views, FIG. 1–4 illustrate printing press inking assembly maintenance apparatus constructed in accordance with the principles of the invention and generally identified by reference character 10. The frame of apparatus 10 includes vertically oriented side panels 11 and 12; horizontally oriented bottom panel 13; horizontally oriented intermediate panels 14–17 and, vertical panels 18 and 19. Lid 20 is connected to panel 19 by hinge 21 which permits lid 20 to be opened as indicated by arrow A in FIG. 2. Steps 23, 24 are attached to front panel 25 by hinges 26, 27 respectively. Vertical elongate rod 28 is pivotally connected to steps 23, 24 at points 30 and 31. Rod 29 is similarly pivotally connected to steps 23, 24. Steps 23, 24 are shown in their extended operative position in FIG. 1 and fold up to the storage position shown in FIG. 2.

Containers 110 of ink solvent fluid are stored on shelf 16 behind towel rack 32. Rags are discarded in removable bin 33 positioned on shelf 15. Colored ink is stored in container 34 on shelf 14, while black ink is stored in container 35 on shelf 17. Apertures formed in the handles of ink knives slide outwardly projecting pegs 37 so the blades of ink knives 38 extend downwardly into the trough of storage unit 39. The trough of unit 39 is preferably filled with ink solvent fluid.

Apertures 40 formed along outwardly extending panel 41 are shaped and dimensioned to receive various tools 42 utilized to service the inking assembly of a printing press. Casters 44–47 are attached at the corners of bottom panel 13 of apparatus 10.

As is illustrated in FIG. 3, the inking assembly of a printing press 60 can include panel-shaped ink fountain 61 which is positioned adjacent the ink fountain roller 62. Ink fountain 61 can, as indicated by arrow B and dashed lines 63, be pivoted downwardly to facilitate cleaning of the fountain. Ink fountain roller 62 is operatively associated with an interconnecting chain of rollers including indoctrination roller 102, transfer rollers 64 and 65, oscillating rollers 66 and 67, and form rollers 68 and 69. Form rollers 68, 69 are operatively associated with plate cylinder 103. A strip of paper 104 passes between blanket cylinders 105, 106. When the inking assembly is being cleaned, ink accumulation tray 50 is positioned with leading edge 51 against the surface of oscillating roller 67. When roller 67 rotates in the clockwise direction indicated by arrow C, ink is scraped from roller 51 into tray 50 in the direction of arrow D. Hook 52 engages peg 53 secured to press 60 and maintains tray 50 in the position shown in FIG. 3 when oscillating roller 67 turns in the direction of arrow C.

Apparatus 10 includes container door 70 for storing and cleaning ink accumulation trays 50. Container 70 includes a floor panel 73 and side panels 74, 75, 76, 77 attached to and outwardly projecting from panel 73. Top panel 90 is attached to panels 74–76. In FIG. 1 member 70 is shown in the closed position. When member 70 is in the closed position, elongate member 74 and floor member 73 are vertically oriented. Member 70 is opened in the direction indicated by arrows E in FIGS. 1 and 2. When member 70 is fully opened, elongate member 74 and bottom panel member 73 are nearly horizontally disposed, with member 77 being slightly higher than panel member 76. The slight slope of bottom member 73 when member 70 is fully opened in the direction of arrow E causes fluid poured into container 70 to flow down the upper surface of member 73 toward panel 76. The fluid accumulates against end panel 76. Grate 80 is attached to bottom panel 73 of member 70. Panel 101 is attached to vertical wall 108. Ink accumulation trays 50 are stored between panel 101 and wall 108.

As illustrated in FIG. 4, grate 80 includes spaced apart members 81 interconnected by elongate panel strip 82.

In FIG. 3 the height of lid 20 above the ground is slightly less than or generally equal to the height of ink fountain 61 above the ground. This feature of the apparatus facilitates cleaning of the fountain 61 because ink can be scraped directly from fountain 61 into bucket 35.

In use, a pressman positions apparatus 10 adjacent a printing press 60 as shown in FIG. 3 and lowers steps 23, 24 to the operative position of FIG. 1. He then obtains a clean ink knife 38, raises lid 20, and scrapes excess ink from fountain 63 into bucket 35. After the majority of ink is scraped from fountain 61 into bucket 35, the pressman closes lid 20 and places knife 38 in storage unit 39 as shown in FIG. 1. Lid 20 prevents dirt and other contaminants from falling into bucket 35 during subsequent servicing of press 60. After lid 20 is closed, the pressman lowers ink fountain 61 to the position indicated by dashed lines 63 and uses blanket wash 110 and clean rags (not shown) carried on cross bar 32 to carefully remove all residual ink from fountain 61. Dirty, ink stained rags are discarded in removable bin 33. An ink accumulation tray 50 is positioned in the manner depicted in FIG. 3 and the printing press operated. As the printing press operates and oscillating roller 67 turns in the direction of arrow C, edge 51 scrapes ink from roller 67 into tray 50. While the printing press continues to operate all ink on rollers 62–66, 68, 69, 102 is transferred through the roller chain to roller 67, consequently, tray 50 gradually removes substantially all residual ink from the roller chain. The ink scraped from roller 67 into pan 50 can be discarded into a waste container carried in apparatus 10 or, if the ink is reusable, it may be scraped into bucket 35. After container 70 is opened so that member 74 is generally horizontally disposed in the manner earlier described, towels and blanket wash are utilized to clean ink accumulation pan 50 on grating 80. Excess blanket wash falls through grating 80 on to panel 73 and flows toward and is apart of panel 76. After pan 50 and other tools have been cleaned, member 70 can be raised to the storage position of FIG. 1. Unless an excessive amount of cleaning fluid was utilized, the reservoir formed by panels 90 and 73–76 at the bottom of member 70 will retain the fluid when member 70 is raised to the storage position of FIG. 1. The fluid trapped in the reservoir in the bottom of member 70 can, after apparatus 10 is rolled to a convenient location, be drained by removing plug 91 inserted in end wall 76.

Steps 23, 24 of apparatus 10 enable a pressman to readily reach and service the ink fountain on presses in which the inking assembly is positioned an appreciable distance above the ground. If the printing press to be serviced by apparatus 10 has an ink fountain located only three to four feet above the ground, steps 23, 24 do not have to be included with apparatus 10.

During cleaning of fountain 61 and the roller chain of the inking assembly, a variety of auxiliary tools 42 may be required to adjust the inking assembly and press or to remove ink from the corners of the ink fountain and from other difficult to reach locations in the ink assembly. Such auxiliary tools 42 are stored in rack 41. A rack (not shown) is also provided on the apparatus for storage of ink dividers. The ink divider rack would include a fluid storage trough similar to trough 39 and would include pegs similar to pegs 37 which would support the ink dividers and permit a portion of the dividers to extend down into fluid carried in trough 39.

After ink fountain 61 and the roller chain have been carefully cleaned, bucket 34 is placed on lid 20 and a clean ink knife 38 is utilized to scoop fresh colored ink from bucket 34 into fountain 61. After fountain 61 has been charged with fresh ink, the inking assembly is ready for operation. During removal of old ink from fountain 61 and from the roller chain, bucket 34 is maintained on floor 14 inside apparatus 10 to prevent various contaminants from falling into bucket 34.

Figure 2:
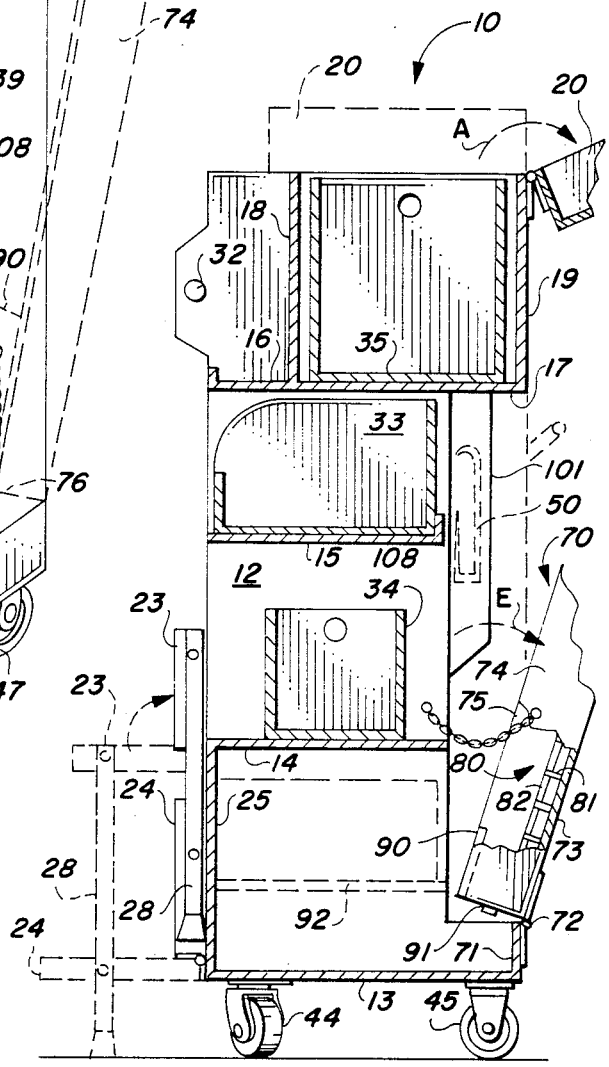
FIG. 2 is a side view of the printing press inking assembly maintenance apparatus of FIG. 1 further illustrating interior construction details thereof.

As indicated in FIG. 2, apparatus 10 may be constructed to include tool drawer 92 or other optional storage facilities.

Container 70 can be attached to apparatus 10 so it may be readily detached from the apparatus and tipped over to permit fluid trapped in container 70 to flow from the container onto the ground.

Shelf 17 can be adjustably mounted in apparatus 10 so that the vertical elevation of panel 17 above the ground can be varied to adjust the height of bucket 35 above the ground. Other portions of the frame of apparatus 10 can be constructed so that the vertical distance from the ground to shelf 17 can be reduced or increased to facilitate positioning the top edge of bucket 35 at approximately the same height as fountain 61 when fountain 61 is folded down 63 for cleaning.

Having described my invention in such terms as to enable those skilled in the art to understand and practice it and having identified the presently preferred embodiments and best mode thereof, I claim:

1. Apparatus for maintenancing the inking assembly of a printing press, said inking assembly including operatively associated rollers positioned on said assembly for transferring and dispensing ink to be applied to sheet material passing through said printing press, and an ink fountain for storing and dispensing to said rollers a supply of printing ink, said fountain being normally maintained on said inking assembly at a generally fixed height above the ground, said apparatus including, in combination, (a) a frame;

(b) at least one ink accumulation tray shaped and dimensioned to be removed from said apparatus and to be positioned adjacent to and scrape ink from one of said printing press ink assembly rollers positioned on said inking assembly;

(c) means for removably carrying and storing said ink accumulation tray on said frame;

(d) an ink knife having a handle and a blade;

(e) means for carrying and storing said ink knife on said frame, said ink knife storage means including a reservoir of cleaning fluid contacting at least a portion of said blade when said ink knife is carried on said frame by said ink knife storage means;

(f) a container of ink solvent fluid carried on said frame;

(g) a fluid tight cleaning sink having a bottom surface and pivotally carried on said frame for movement between at least two operative positions, a first normal operative storage position with said bottom surface generally vertically disposed, and a second operative position with said bottom surface generally horizontally disposed, said sink being utilized to receive fluid when said sink is in said second operative position;

(h) a container carried on said frame for receiving ink removed from the ink fountain of said printing press; and, (i) a supply of fresh ink carried on said frame for the ink fountain of said printing press, said frame being shaped, contoured and dimensioned and said ink container being positioned thereon such that said frame carried thereon can be positioned on the ground adjacent said ink fountain and ink can be scraped from said ink fountain directly into said ink container.

2. The apparatus of claim 1 including steps carried on said frame enabling an individual to ascend toward said ink fountain when said frame is positioned adjacent thereto.

3. The apparatus of claim 2 including a lid mounted on said frame and movable between at least two operative positions, (a) a first operative position covering said ink container, and (b) a second operative position exposing said ink container such that ink can be scraped directly from said fountain into said container when said frame and container are positioned adjacent said ink fountain.

* * * * *